US007757934B2

(12) United States Patent
Coltri-Johnson

(10) Patent No.: US 7,757,934 B2
(45) Date of Patent: Jul. 20, 2010

(54) CORNER DISPENSER FOR CARTONS

(75) Inventor: Andrea Coltri-Johnson, Acworth, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 601 days.

(21) Appl. No.: 11/266,718

(22) Filed: Nov. 3, 2005

(65) Prior Publication Data

US 2006/0091192 A1 May 4, 2006

Related U.S. Application Data

(60) Provisional application No. 60/624,653, filed on Nov. 3, 2004.

(51) Int. Cl.
*B65D 5/00* (2006.01)
*B65D 17/00* (2006.01)

(52) U.S. Cl. ..... 229/122; 229/242

(58) Field of Classification Search ..... 229/122, 229/241; 221/302, 305, 240
See application file for complete search history.

(56) References Cited

U.S. PATENT DOCUMENTS

| | | | | |
|---|---|---|---|---|
| 1,585,494 | A * | 5/1926 | Harvey | 229/122 |
| 2,974,846 | A | 3/1961 | Struble | |
| 3,228,582 | A * | 1/1966 | Osberg | 229/238 |
| 3,300,115 | A * | 1/1967 | Schauer | 221/305 |
| 3,567,102 | A | 3/1971 | Miller | |
| 3,765,593 | A * | 10/1973 | D'Alessio | 229/123.3 |
| 5,344,066 | A | 9/1994 | Fogle | |
| 6,283,293 | B1 | 9/2001 | Lingamfelter | |
| 6,478,219 | B1 * | 11/2002 | Holley, Jr. | 229/240 |
| 6,604,677 | B1 | 8/2003 | Sutherland et al. | |
| 6,669,083 | B2 | 12/2003 | Bates | |
| 7,296,731 | B2 * | 11/2007 | Auclair et al. | 229/242 |
| 2002/0185527 | A1 | 12/2002 | Bates | |
| 2004/0040877 | A1 | 3/2004 | Lingamfelter | |
| 2004/0089575 | A1 | 5/2004 | Lingamfelter | |
| 2004/0159671 | A1 | 8/2004 | Spivey | |
| 2006/0091192 | A1 | 5/2006 | Coltri-Johnson | |

FOREIGN PATENT DOCUMENTS

| | | | |
|---|---|---|---|
| GB | 2 300 853 | A | 11/1996 |

* cited by examiner

*Primary Examiner*—Nathan J Newhouse
*Assistant Examiner*—Christopher Demeree
(74) *Attorney, Agent, or Firm*—Womble Carlyle Sandridge & Rice, PLLC

(57) ABSTRACT

A carton has a removable dispenser that forms a dispenser opening in an upper corner of the carton. The corner opening allows articles to be easily removed from the carton while preventing unwanted dispensing of articles from the carton.

16 Claims, 9 Drawing Sheets

CORNER DISPENSER FOR CARTONS

RELATED APPLICATIONS

This application claims the benefit of U.S. Provisional Application No. 60/624,653, filed Nov. 3, 2004 and entitled "Corner Dispenser for Cartons," the entire contents of which are hereby incorporated by reference as if presented herein in their entirety.

BACKGROUND

Enclosed cartons with dispensing features have been used in the past. Many of these cartons include article dispensers defined by lines of disruption such as tear lines, cuts, score lines, and fold lines. A dispenser may be removable from, or hingedly attached to, a carton to create an opening from which articles can be removed from the carton. Many such dispensers provide inadequate access to articles within the cartons, unnecessarily weaken the cartons when opened, and/or allow inadvertent escape of articles from the cartons.

SUMMARY

According to a first embodiment of the invention, a carton comprises a dispenser that when opened, forms a dispenser opening in an upper or top corner of an exiting end of the carton. Once the corner dispenser is opened or placed in a dispensing configuration, portions of the carton's exiting end and side panel remain intact and are capable of retaining articles within the carton.

According to one aspect of the present invention, the corner dispenser opening provides easy access to selected articles within the carton, while securely retaining the remaining articles from inadvertently exiting the carton. If desired, a portion of the opened dispenser may remain hingedly attached to the remainder of the carton.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

The present invention generally relates to dispensers for cartons. The present invention can be used, for example, in cartons that contain articles or other products such as, for example, food and beverages. The articles can also include beverage containers such as, for example, cans, bottles, PET containers, or other containers such as those used in packaging foodstuffs. For the purposes of illustration and not for the purpose of limiting the scope of the present invention, the following detailed description describes generally cylindrical beverage containers as disposed within the carton embodiments. In this specification, the relative terms "lower," "bottom," "upper" and "top" indicate relative orientations determined in relation to fully erected cartons.

Figure 1:
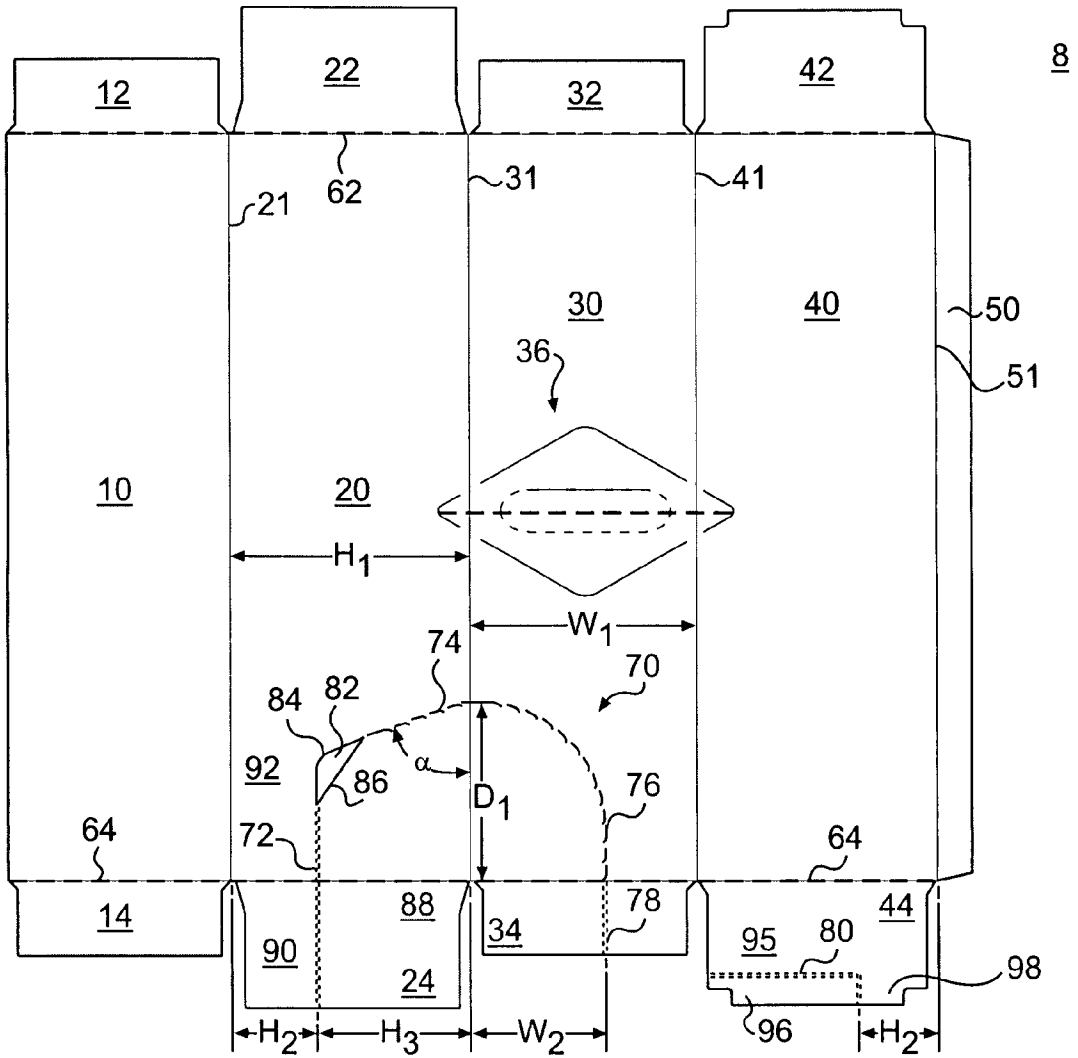
FIG. 1 is a plan view of a blank used to form a carton according to a first embodiment of the invention.

FIG. 1 is a plan view of the interior side of a blank 8 used to form a carton 150 (illustrated in FIGS. 2A and 2B) according to a first embodiment of the invention. The blank 8 comprises a bottom panel 10 foldably connected to a first side panel 20 at a first transverse fold line 21, a top panel 30 foldably connected to the first side panel 20 at a second transverse fold line 31, and a second side panel 40 foldably connected to the top panel 30 at a third transverse fold line 41. An adhesive flap 50 can be foldably connected to the second side panel 40 at a fourth transverse fold line 51. The blank 8 may include a handle 36 in the top panel 30.

The bottom panel 10 is foldably connected to a first bottom end flap 12 and a first bottom exiting end flap 14. The first side panel 20 is foldably connected to a first side end flap 32 and a first side exiting end flap 34. The top panel 30 is foldably connected to a top end flap 32 and a top exiting end flap 34. The second side panel 40 is foldably connected to a second side end flap 42 and a second side exiting end flap 44. When the carton 150 is erected, the end flaps 12, 22, 32, 42 close one end of the carton 150, and the exiting end flaps 14, 24, 34, 44 close an exiting end of the carton 150. The end flaps 12, 22, 32, 42 may extend along a first marginal area of the blank 8, and may be foldably connected at a first longitudinal fold line 62 that extends along the length of the blank 8. The exiting end flaps 14, 24, 34, 44 may extend along a second marginal area of the blank 8, and may be foldably connected at a second longitudinal fold line 64 that also extends along the length of the blank 8. The longitudinal fold lines 62, 64 may be, for example, substantially straight, or offset at one or more locations to account for blank thickness or for other factors.

Figure 2A:
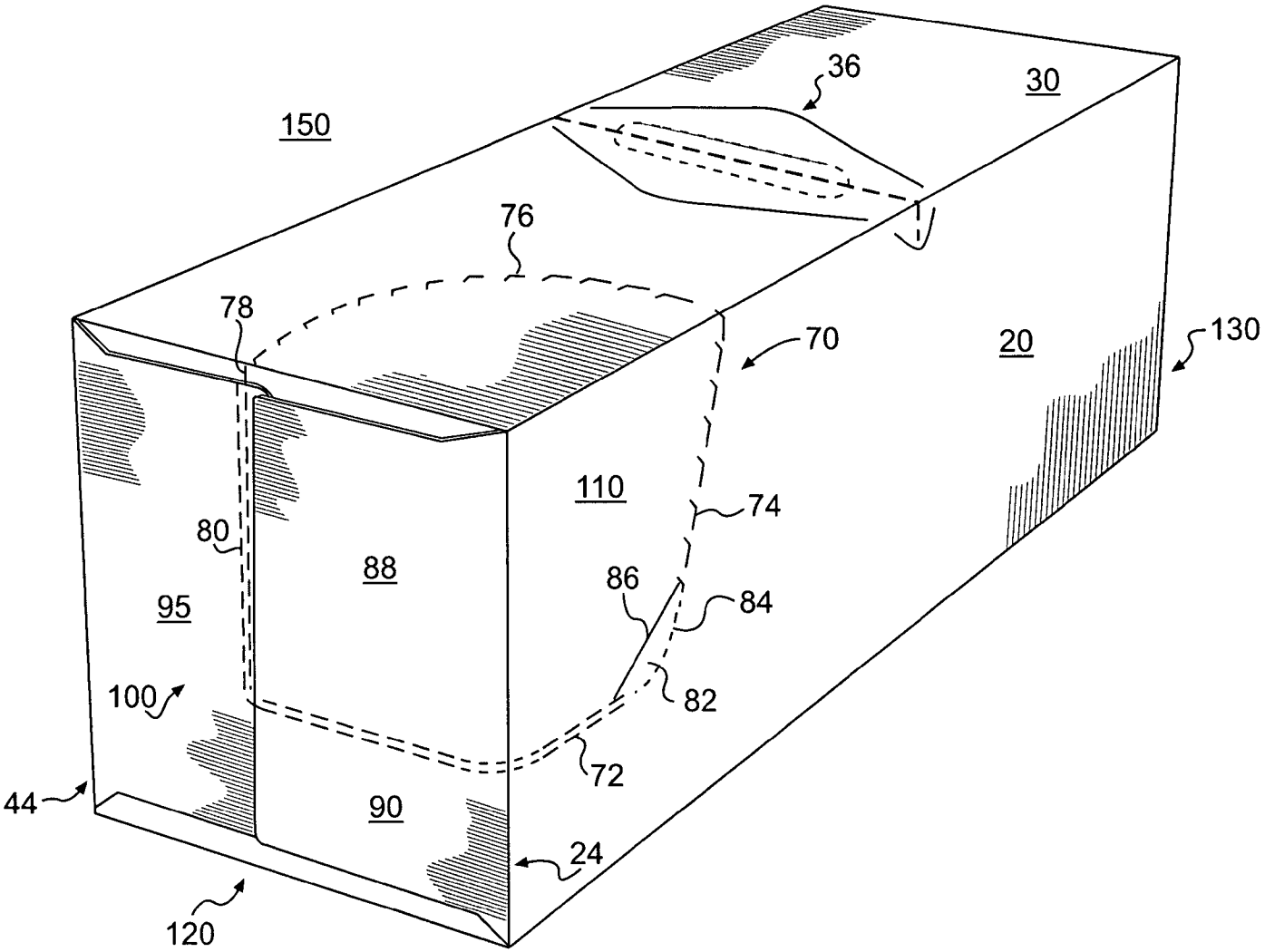
FIG. 2A is a perspective view of the carton according to the first embodiment of the invention.
Figure 2B:
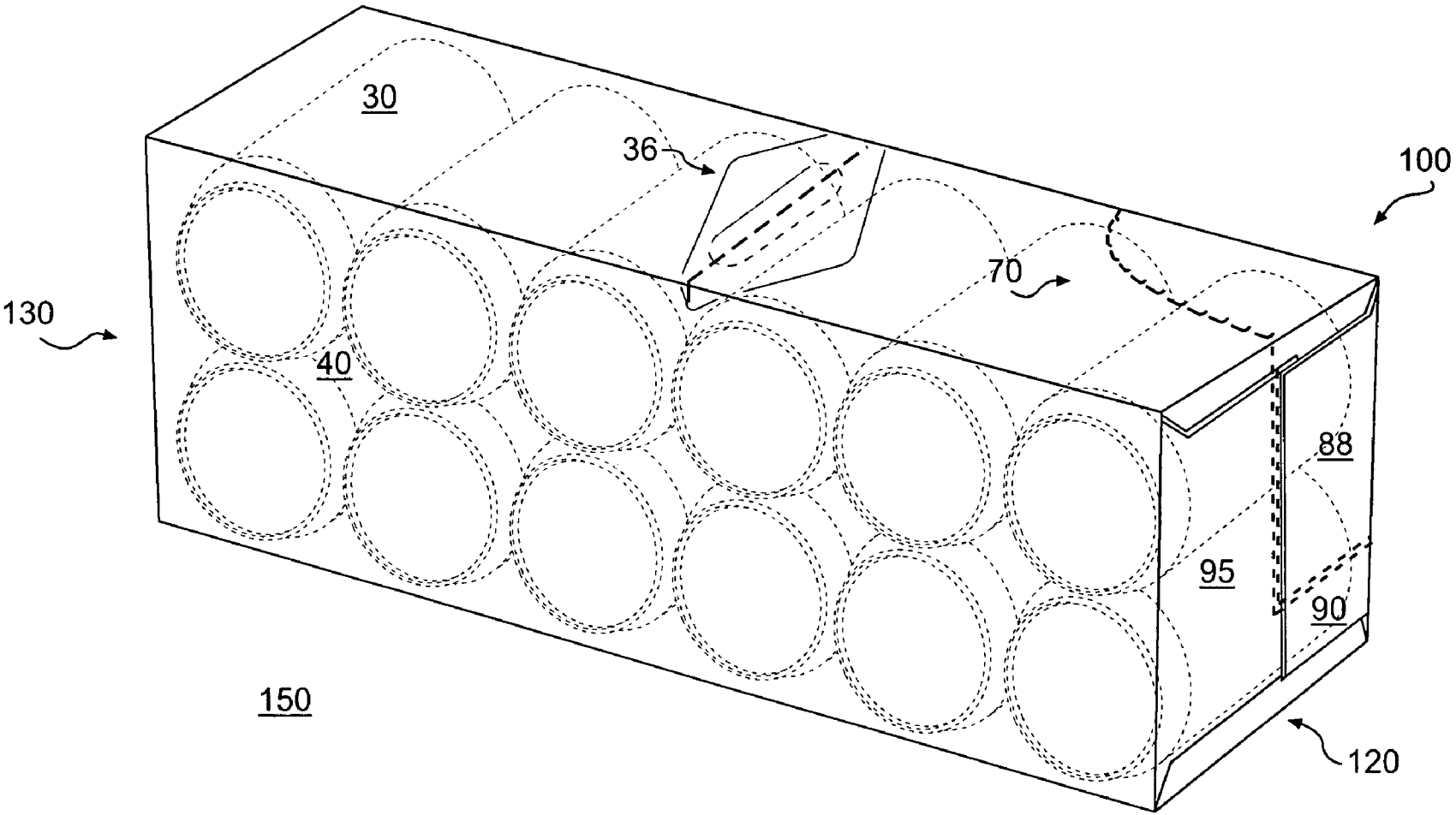
FIG. 2B is another perspective view of the carton according to the first embodiment.

The carton blank 8 includes a dispenser pattern 70 that defines a corner dispenser 100 in an upper corner of the erected carton 150 (illustrated in FIGS. 2A and 2B). The dispenser pattern 70 extends across the first side panel 20, the top panel 30, and across the exiting end flaps 24, 34, 44. A portion of the perimeter of the dispenser pattern 70 is defined by a first tear line 72, a tear second line 74, a third tear line 76, and a fourth tear line 78, all of which may be contiguous or substantially contiguous with one another. A fifth tear line 80 of the dispenser pattern 70 is formed in the exiting end flap 44.

The first tear line 72 extends in what may be a substantially straight line transversely across the blank 8 from an edge of the first side exiting end flap 24, across the longitudinal fold line 64, and into the first side panel 20. The first tear line 72 divides the first side exiting end flap 24 into a first tear away section 88 and an end retainer section 90. The first tear line 72 also defines a side retainer section 92 in the first side panel 20. The second tear line 74 extends obliquely along at least a majority of its length through the first side panel 20 and connects to the third tear line 76. The third tear line 76 may extend in a generally arcuate path along at least a majority of its length across the top panel 30, and turns to extend to the second longitudinal fold line 64. The fourth tear line 78 extends from the second longitudinal fold line 64, adjacent to an end of the third tear line 76, to an exterior edge of the top exiting end flap 34. The fourth tear line 78 may be substantially straight. The fifth tear line 80 extends in an ell-shape or dogleg shape from a top edge of the second side exiting end flap 44 to an end edge of the flap 44. The fifth tear line 80 defines a tear away section 96 and end retainer sections 95, 98 in the second side exiting end flap 44, and can include two orthogonal or substantially orthogonal sections.

An access flap 82 can be defined in the first side panel 20 by a dogleg-shaped or ell-shaped access cut or tear line 84 that extends between the first tear line 72 and the second tear line 74, and a fold line 86 about which the access flap 82 may pivot or otherwise deform inwardly. Alternatively, the access flap 82 can be omitted and an access opening or aperture can be defined by the lines 84, 86. Multiple access flaps may, for example, be included in the dispenser pattern 70 at selected locations within the dispenser pattern.

The first through fifth tear lines 72, 74, 76, 78, 80 of the dispenser pattern 70 can be continuous or substantially continuous tear lines formed by, for example, scores, creases, cuts, gaps, cut/creases, perforations, offset cuts, and combinations thereof. If cuts are used to form the dispenser pattern tear lines 72, 74, 76, 78, 80, the cuts may be interrupted by, for example, one or more breachable nicks. The access flap 82 can generally be disposed in any position along the first side panel 20, the exiting end flaps 24, 34, or the top panel 30. The access flap 82 can be designed to provide easy initial access for opening of the dispenser 100, and may therefore be formed from a continuous cut 84, a cut interrupted by nicks, and/or other easily breachable lines of disruption.

The dimensions and shape of the blank 8 may be selected to accommodate the characteristic dimensions of an article or articles to be accommodated within the carton 150. For example, the top panel 30 can have a width $W_1$ that generally corresponds to or slightly exceeds a height $H_C$ of containers C (FIGS. 2A and 2B) to be held within the carton 150. The first and second side panels 20, 40 can have, for example, heights $H_1$ that generally correspond to or slightly exceed an integral multiple of a largest or characteristic diameter $D_C$ of the containers C. For example, if the containers C are to be stacked in two rows (illustrated in FIG. 2B) in the carton 150, the height $H_1$ of the carton 150 can be slightly greater than twice the containers' C largest or characteristic diameter $D_C$. If multiple generally cylindrical containers C, such as beverage containers, are to be accommodated, it may be expected that the containers will share at least one substantially equal common largest diameter $D_C$.

The end retainer section 90 in the first side exiting end flap 24 can have, for example, a height $H_2$ in the range of, for example, about 20-110% of the characteristic dimension or diameter $D_C$ of the containers C. The end retainer section 98 in the second side end flap 44 can also have a height $H_2$. The second tear line 74 can extend generally at an angle $\alpha$ that is in the range of, for example, about 30-80 degrees with respect to the second transverse fold line 31. The second and third tear lines 74, 76 can extend into the panels 20, 30 a depth of $D_1$ in the range of, for example, about 90-300% of the characteristic dimension or diameter $D_C$.

The carton 150 may be erected from the blank 8 by gluing or otherwise adhering the adhesive flap 50 (shown in FIG. 1) to the inner side of the bottom panel 10 so that the bottom panel 10, the first side panel 20, the top panel 30, and the second side panel 40 may be opened or set up to form a generally tubular sleeve. The ends of the generally tubular sleeve may be closed, for example, by folding and adhering the end flaps 12, 22, 32, 42 and the exiting end flaps 14, 24, 34, 44. Containers C or other articles, for example, may be loaded into the sleeve in a conventional manner at any time before one or both ends of the carton are closed by the end flaps 12, 22, 32, 42, 14, 24, 34, 44.

FIGS. 2A and 2B are perspective views of the carton 150 erected from the blank 8 illustrated in FIG. 1. In the erected carton 150, the end flaps 12, 22, 32, 42 form an end panel 130 and the exiting end flaps 14, 24, 34, 44 form an exiting end panel 120. The dispenser pattern 70 forms a corner dispenser 100 that extends across the corner existing at the intersection of the exiting end panel 120, the top panel 30, and the first side panel 20. The carton dispenser 100 includes a dispenser flap 110 that may be either wholly or partially removed in order to open the carton 150. The dispenser flap 110 extends in the three planes occupied by the exiting end panel 120, the top panel 30, and the first side panel 20. Opening of the carton dispenser 100 to place the carton 150 in a dispensing configuration will be discussed below with reference to FIGS. 3-6.

Figure 3:
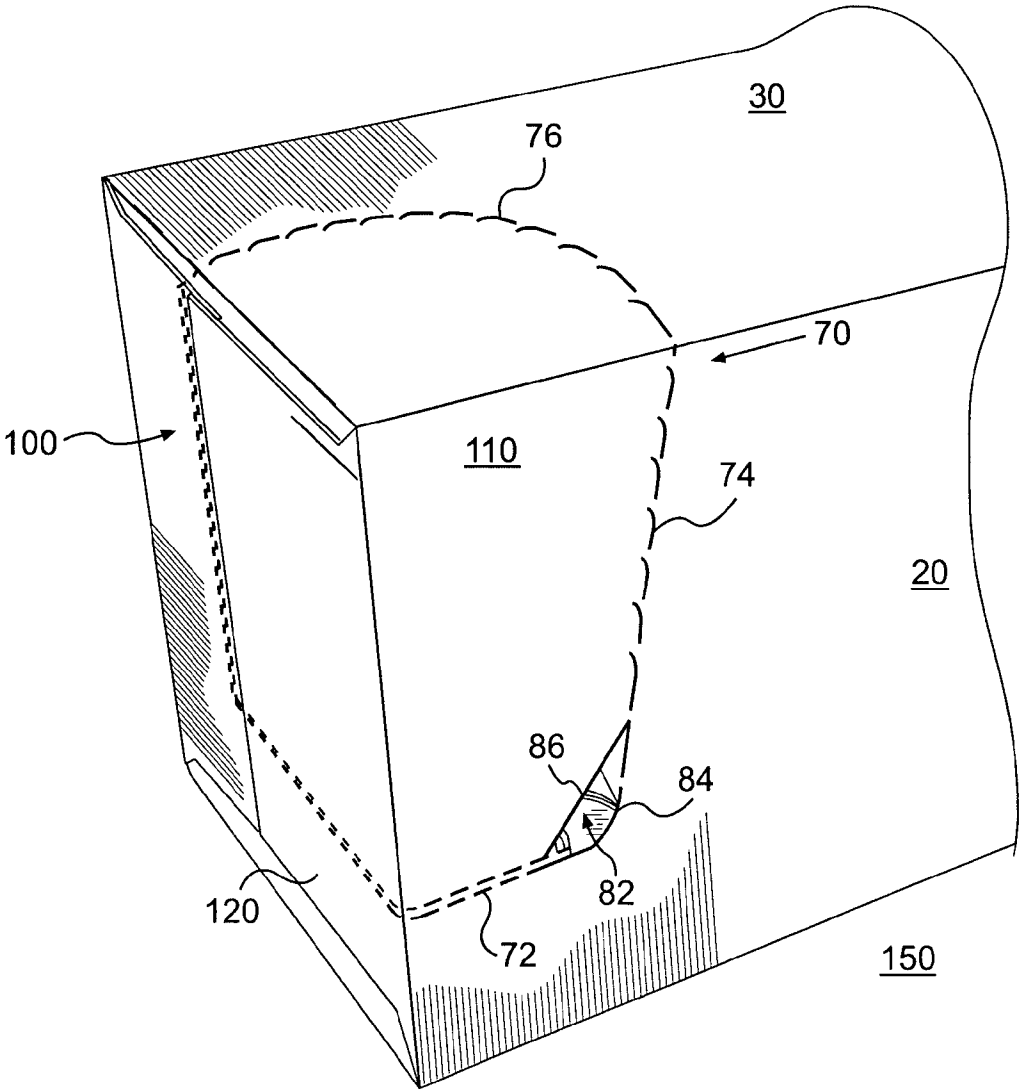
FIGS. 3-5 illustrate the first carton embodiment being placed in an opened or dispensing configuration.

Referring to FIG. 3, opening of the dispenser 100 may be initiated by inserting a finger, fingers, tool, or other object into the carton 150 at the access flap 82. The access flap 82 may be, for example, defined by the cut line 84 to allow for ease of insertion. The cut line 84 can be, for example, a continuous cut, or a cut interrupted by nicks. Other lines of disruption in the carton 150 may also be used to form the access flap 82. Alternatively, an access opening or aperture may be provided at the location of the flap 82.

Figure 4:
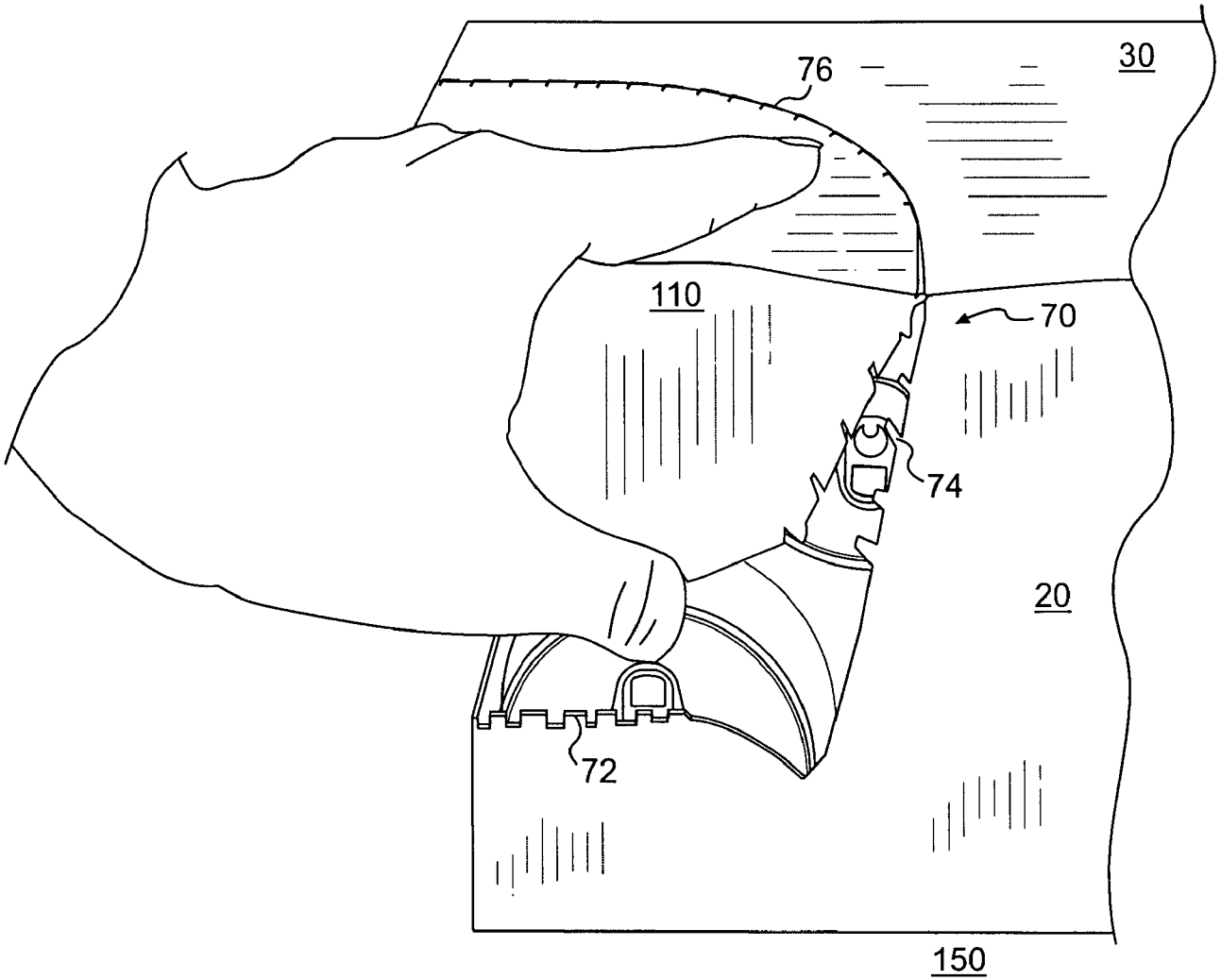

Referring to FIG. 4, the dispenser 100 may be opened by pulling the dispenser flap 110 outwardly and/or upwardly and tearing the carton 150 along the first and second tear lines 72, 74.

Figure 5:
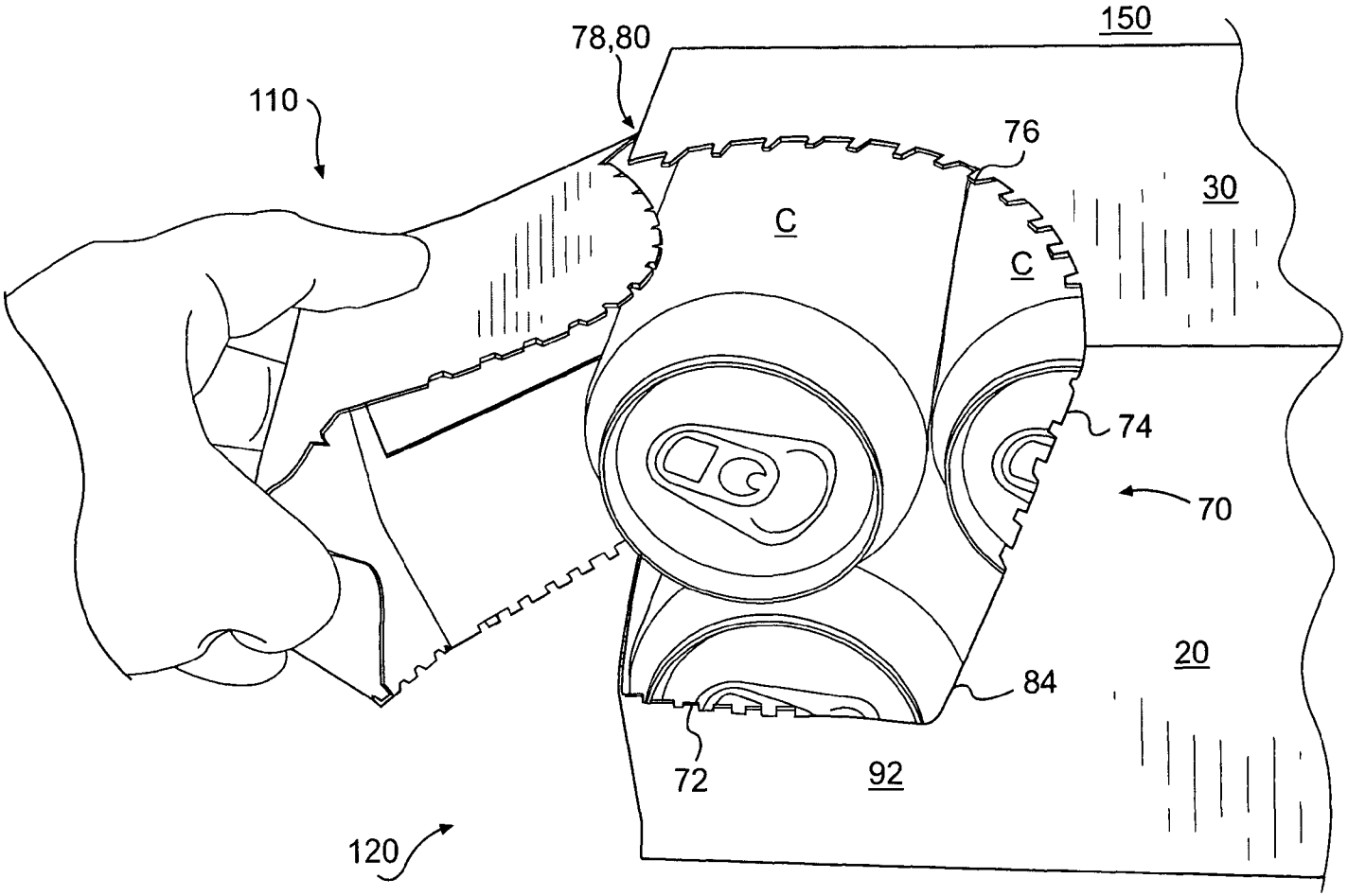
Figure 6:
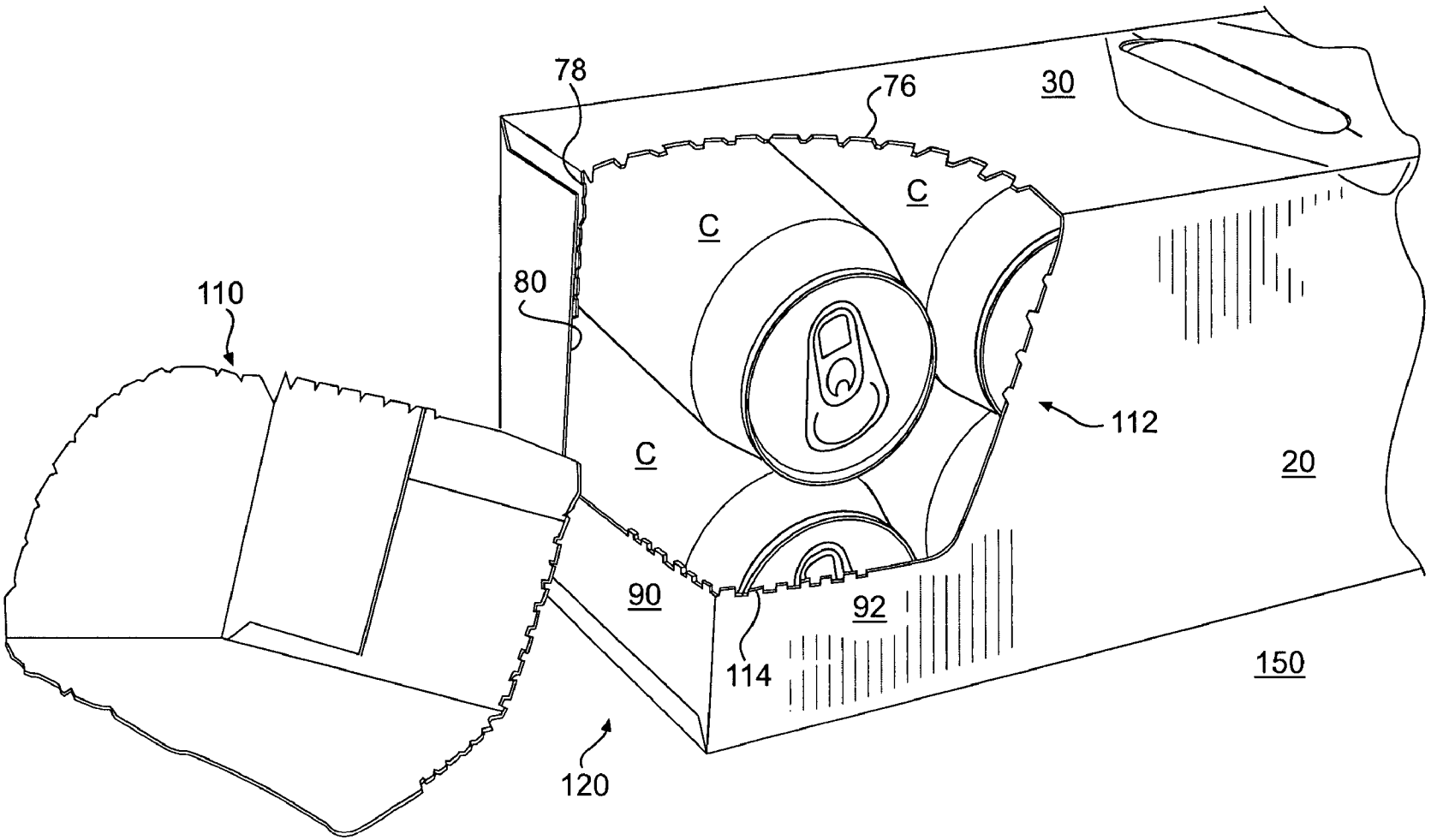
FIG. 6 is a partial, perspective view of the first carton embodiment in the dispensing configuration.

Referring to FIGS. 5 and 6, the dispenser 100 is fully opened by tearing the carton along the third, fourth and fifth tear lines 76, 78, 80 to remove the dispenser flap 110 and thereby form a dispenser opening 112. The lower end of the dispenser opening 112 is defined by a lower edge 114 (FIG. 6) extending across the remainder of the exiting end panel 120 and the first side panel 20. The lower edge of the dispenser opening 114 is the top edge of the horizontally extending end retainer wall 90 and side retainer wall 92.

Figure 7:
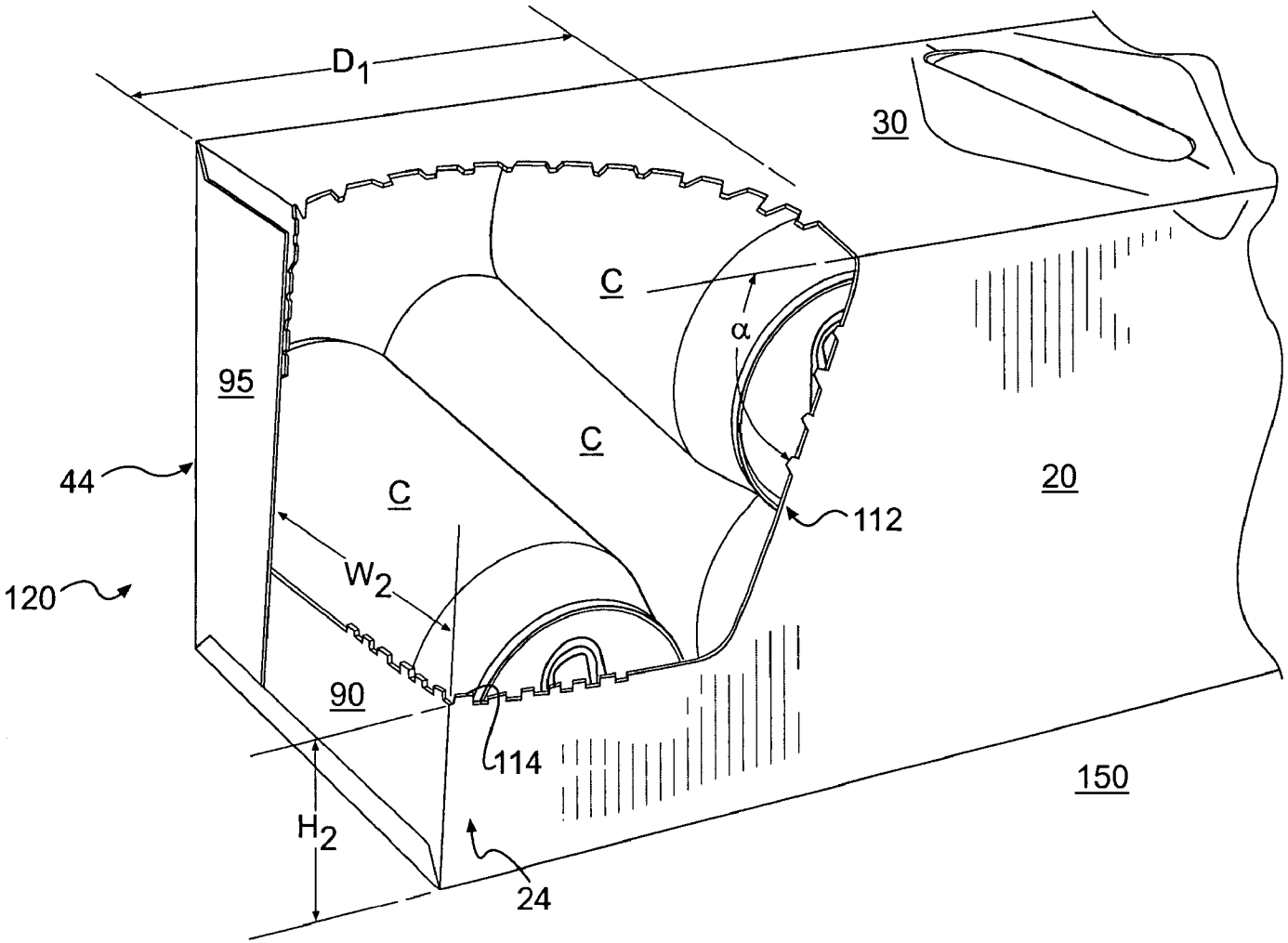
FIG. 7 is another partial, perspective view of the first carton embodiment in the dispensing configuration.
Figure 8:
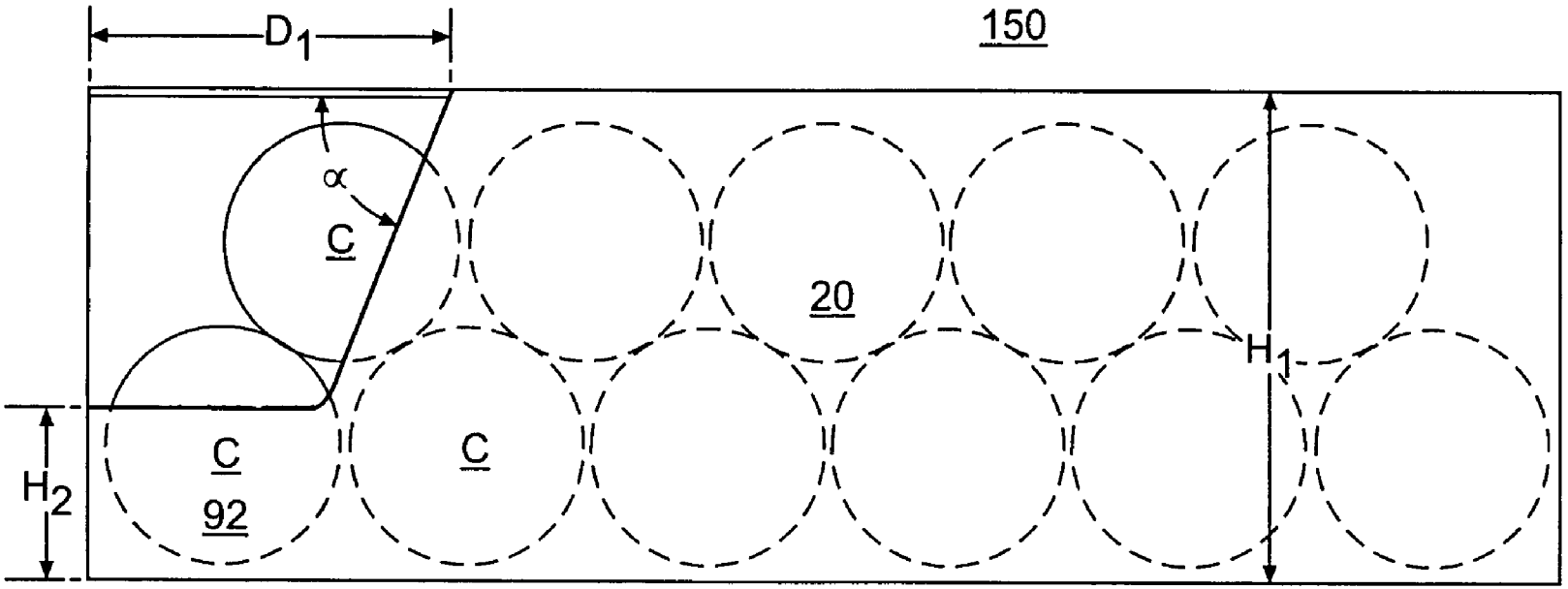
FIG. 8 is a side schematic view of the first carton embodiment in the dispensing configuration.

FIGS. 7 and 8 are a partial perspective and a schematic side view, respectively, of the carton 150 in the fully opened or dispensing configuration. In the exemplary embodiment, the carton 150 encloses twelve 12 ounce beverage containers C arranged in the carton 150 in a two row and six column (2×6) configuration (shown in FIG. 2B). In FIGS. 7 and 8, one container C has been removed through the dispenser opening 112.

In the dispensing configuration, containers C may be withdrawn from the upper corner of the opened carton 150 through the dispenser opening 112. In general, with the dispenser flap 110 removed, a container or containers C adjacent to the dispenser opening 112 can be easily accessed and removed from the carton 150. Referring to FIG. 7, the end retainer section 90 in the first side end flap 24 and the side retainer section 92 in the first side panel 20 can have a height $H_2$ in the range of about 20-110% of the container characteristic dimension or diameter $D_C$, which may be sufficient to prevent a bottom or lower row of containers C from rolling out of the exiting end of the carton 150.

Referring to FIGS. 7 and 8, the vertically extending end retainer section 95 in the exiting end panel 120 may extend across the full height of the exiting end of the carton 150 to prevent containers C from inadvertently rolling out of the carton. As shown in FIG. 8, the height of the lower edge 114 of the dispenser opening 112 may be high enough to prevent containers C from escaping through the side of the opened carton 150. Also, the dispenser opening 112 may extend downwardly in the exiting end panel 120 such that containers C in a bottom or lower row may also be easily accessible by hand.

Referring to FIGS. 7 and 8, the depth $D_1$ that the corner dispenser 100 extends into the top and side panels 30, 20 may be selected so that a container C in the top row of containers C may be easily pulled through the dispenser opening 112, as well as containers C in a bottom or lower row adjacent to the exiting end panel 120. The depth $D_1$ may also be selected so that containers C further back in the carton 150 may be removed from the carton through the dispenser opening 112. For example, the depth $D_1$ can be selected so that containers C two, three, four or more columns back in the carton 150 may be accessed through the dispenser opening 112.

FIGS. 7 and 8 illustrate the dispenser flap 110 completely separated from a remainder of the carton 150. A user may optionally choose to leave a portion of the dispenser pattern 70 intact, and thus create a hingedly attached dispenser flap 110. For example, referring to FIG. 5, the dispenser flap 110 has been separated from the first side panel 20, the top panel 30, and a portion of the exiting end panel 120, but at least a portion of the tear lines 78, 80 in the exiting end panel 120 have not been torn. Opening of the dispenser 100 can be halted at this point at the discretion of the user. The dispenser flap 110 therefore remains pivotably attached at one or both of the tear lines 78, 80. The user has the option of completely removing the dispenser flap 110 at a later time, or, partially or wholly reclosing the dispenser flap 110 about the hinge tear lines 78, 80. The hinged attachment could alternatively be formed, for example, along the first side panel 20 or the top panel 30.

EXAMPLE 1

A carton 150 as illustrated in FIGS. 2A and 2B accommodates twelve 12 ounce beverage cans having a container diameter $D_C$ of about 2 and ½ in and a height $H_C$ of about 4 and 13/16 in. The containers are arranged in two rows, six columns of cans to each row (2×6 configuration, as shown in FIG. 2B). The carton has a height $H_1$ of about 5 and 7/32 in. and a width $W_1$ of about 4 and 27/32 in. The distance $D_1$ is about 130% of container diameter $D_C$. The height $H_2$ of the lower edge 114 of the dispenser opening is about 60% of container diameter $D_C$, and the height $H_3$ (shown in FIG. 1) is about 140% of container diameter $D_C$. The lines 74, 76 are tear lines and the longitudinal fold lines 62, 64 are cut/crease lines. The fold lines 21, 31, 41, 51 are crease lines and the lines 72, 78, 80 are tear lines formed from offset cut/space lines.

According to the above embodiments, articles may be easily removed from the open upper corner of a carton when the carton dispenser is opened. The corner opening provides visibility of the articles inside the carton without entirely exposing all of the articles. The corner dispenser generally may be formed by perforations or cut lines, which are of such dimensions to provide access to cans or other articles in the carton, without unnecessarily weakening the panel or panels in which the corner dispenser is formed. After the removal of the dispenser flap, the remaining portions of the carton at the exiting end and in the first side panel prevent articles, and specifically the next article in the columns or rows of articles adjacent to the exiting end, from inadvertently falling or rolling out of the carton. Thus, the articles are securely retained inside the carton until selectively removed.

For purposes of illustration, the present invention is generally disclosed in the context of paperboard cartons or packages sized and dimensioned to contain cylindrical beverage containers. The cartons illustrated in the drawing figures are sized to accommodate containers in a two row configuration with multiple columns of containers included in each row, although the present invention is not limited to any specific size or dimension. For example, the present invention would work satisfactorily if sized and shaped to hold containers in alternative arrangements, such as 3×4, 4×3, 2×4, 2×5, 4×6, 4×5, 3×6, 5×6, etc.

If a carton according to the present invention is designed to accommodate three rows of containers, the height $H_2$ of the lower edge of the dispenser opening may be selected to, for example, extend across or at least partially block the second or intermediate row of containers C. The height $H_2$ may be also be lower, for example, and the dimensions of the end retainer wall 95 and/or the profile of the second tear line 74 extending through the first side panel 20 may be changed in order to secure the bottom and/or intermediate rows of containers when the dispenser is placed in the dispensing configuration. If four or more rows of containers are to be accommodated, the height of the lower edge of the dispenser opening, the depth $D_1$, and other dimensions of the blank can be further adjusted in order to provide a desired accessibility for the various rows.

The present invention can be used in cartons that include various features, including additional opening features that provide easy access to the articles, and tilt features that position the articles at the front end of the carton.

One of ordinary skill will recognize that the corner dispenser according to the present invention can be disposed in any upper corner of a carton. Further, although not shown in the figures, it is understood that a carton according to the present invention could include spaced corner dispensers on each side of one end of the exiting end of the carton. In such a scenario, a remaining portion of the exiting end would provide the stop or retention feature in the exiting end. Corner dispensers could also be provided at opposite ends of a carton.

The blanks according to the present invention can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the dispensers to function at least generally as described above. The blanks can also be laminated to or coated with one or more sheet-like materials at selected panels or panel sections.

In accordance with the above-described embodiments of the present invention, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line or other line of disruption.

The above embodiments may be described as having one or panels adhered together by glue during erection of the carton embodiments. The term "glue" is intended to encompass all manner of adhesives commonly used to secure carton panels in place.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A carton in combination with a plurality of generally cylindrical containers contained in an interior of the carton, wherein the containers have a common diameter, the carton comprising:

a bottom panel;

a first side panel positioned at a side of the carton, the first side being foldably connected to the bottom panel;

a top panel positioned at a top of the carton, the top panel being foldably connected to the first side panel;

a second side panel foldably connected to the top panel;

an exiting end panel positioned at an end of the carton, the exiting end panel comprising a top exiting end flap foldably connected to the top panel and a first side exiting end flap foldably connected to the first side panel, the top exiting end flap and the first side exiting end flap being respectively foldably connected to one of the top panel and the first side panel at a longitudinally extending fold line;

a corner dispenser defined at least in part by a dispenser pattern extending through the top panel, the first side panel, and the exiting end panel, wherein the first side panel, the exiting end panel, and the top panel meet at a first upper corner, the second side panel, the exiting end panel, and the top panel meet at a second upper corner, the dispenser pattern is disposed around the first corner and comprises a first tear line extending across the side exiting end flap and the first side panel, the first tear line extending at a height above the bottom panel that is at least twenty percent of the diameter, the first tear line extending perpendicular to the longitudinally extending fold line and extending from the longitudinally extending fold line to an edge of the side exiting end flap, and a second tear line extending across the first side panel and upwardly toward the top panel, the second tear line extending a depth into the first side panel that is at least ninety percent of the diameter, a third tear line extending from the second tear line and across the top panel, wherein the third tear line is arcuate along at least a majority of its length, a fourth tear line extending downwardly from the top panel and through the exiting end panel, the dispenser pattern defines a dispenser flap that is at least partially separable along the dispenser pattern to form an upper corner dispenser opening at the first upper corner, the carton comprises an access feature in the side panel for providing access to the dispenser flap to initiate separation of the dispenser flap from the carton, the access feature being located between respective ends of the first tear line and the second tear line, the respective ends are located in the first side panel and removal of the dispenser flap removes the first upper corner so that the upper corner dispenser opening is open to the interior of the carton at each of the top of the carton, the side of the carton and the end of the carton, and leaves the second upper corner intact.

2. The carton in combination with the plurality of containers of claim 1, wherein the third and fourth lines are spaced from the second upper corner and the second side panel.

3. A method of removing articles from a carton, comprising:

providing the carton in combination with the plurality of containers according to claim 1;

tearing the carton along at least a part of the dispenser pattern, wherein tearing the carton at least partially separates the dispenser flap to form the upper corner dispenser opening, the upper corner dispenser opening exposing the first upper corner of the carton and leaving the second upper corner intact; and removing a container through the upper corner dispenser opening.

4. The method of claim 3, wherein tearing the carton creates a bottom edge of the dispenser opening, the bottom edge of the dispenser opening extending across the exiting end panel and the first side panel.

5. The method of claim 4, wherein the bottom edge of the dispenser opening is at a height of at least twenty per cent of the diameter.

6. The method of claim 3, wherein tearing the carton leaves a vertically extending end retainer wall in the exiting end panel, the vertically extending end retainer wall being adjacent to the second side panel.

7. The method of claim 6, wherein tearing the carton leaves a horizontally extending end retainer wall in the exiting end panel, the horizontally extending end retainer wall being adjacent to the vertically extending end retainer wall.

8. The method of claim 7, wherein tearing the carton leaves a horizontally extending side retainer wall in the first side panel, the horizontally extending side retainer wall being adjacent to and substantially perpendicular to the horizontally extending end retainer wall.

9. The carton in combination with the plurality of containers of claim 1, wherein the respective ends of the first and second tear lines comprise a first terminal end of the first tear line and a second terminal end of the second tear line, the first and second terminal ends being in the first side panel and the access feature being located between the first and second terminal ends.

10. The carton in combination with the plurality of containers of claim 9, wherein the access feature comprises an access flap connected to the dispenser flap at an access fold line and separable from the first side panel along an access cut line so that the access flap is removed with the first upper corner.

11. The carton in combination with the plurality of containers of claim 10, wherein the access fold line comprises a first end that is generally coincident with the first terminal end and a second end that is generally coincident with the second terminal end.

12. The carton in combination with the plurality of containers of claim 1, wherein the first tear line extends perpendicular to the longitudinally-extending fold line along the length of the first tear line in the first side panel.

13. A carton in combination with a plurality of generally cylindrical containers contained in an interior of the carton, wherein the containers have a common diameter, the carton comprising:

a bottom panel;

a first side panel positioned at a side of the carton, the first side being foldably connected to the bottom panel;

a top panel positioned at a top of the carton, the top panel being foldably connected to the first side panel;

a second side panel foldably connected to the top panel;

an exiting end panel positioned at an end of the carton, the exiting end panel comprising a top exiting end flap foldably connected to the top panel and a first side exiting end flap foldably connected to the first side panel, the top exiting end flap and the first side exiting end flap being respectively foldably connected to one of the top panel and the first side panel at a longitudinally-extending fold line; and a corner dispenser defined at least in part by a dispenser pattern extending through the top panel, the first side panel, and the exiting end panel, wherein the first side panel, the exiting end panel, and the top panel meet at a first upper corner, the second side panel, the exiting end panel, and the top panel meet at a second upper corner, the dispenser pattern is disposed around the first corner and comprises a first tear line extending across the side exiting end flap and the first side panel, the first tear line extending perpendicular to the longitudinally extending fold line and extending from the longitudinally extending fold line to an edge of the side exiting end flap, and a second tear line extending across the first side panel and upwardly toward the top panel, a third tear line extending from the second tear line and across the top panel, wherein the third tear line is arcuate along at least a majority of its length, a fourth tear line extending perpendicular to the longitudinally extending fold line and extending from the longitudinally extending fold line to an edge of the top exiting end flap, the dispenser pattern defines a dispenser flap that is at least partially separable along the dispenser pattern to form an upper corner dispenser opening at the first upper corner, the carton comprises an access feature in the first side panel for providing access to the dispenser flap to initiate separation of the dispenser flap from the carton, the access feature being located between respective ends of the first tear line and the second tear line, the respective ends are located in the first side panel and removal of the dispenser flap removes the first upper corner so that the upper corner dispenser opening is open to the interior of the carton at each of the top of the carton, the side of the carton and the end of the carton, and leaves the second upper corner intact.

14. The carton of claim 13, wherein the blank further comprises a second side exiting end flap foldably connected to the second side panel at the longitudinally extending fold line, the dispenser pattern further comprises a fifth tear line extending through the second side exiting end flap.

15. A blank for forming a carton, comprising:

a bottom panel;

a first side panel foldably connected to the bottom panel;

a top panel foldably connected to the first side panel;

a second side panel foldably connected to the top panel;

a first side exiting end flap foldably connected to the first side panel at a longitudinally extending fold line;

a top exiting end flap foldably connected to the top panel at the longitudinally extending fold line;

a dispenser pattern extending through the top panel, the first side panel, the first side exiting end flap, and the first top exiting end flap and defining a dispenser flap that is at least partially separable along the dispenser pattern and forms an upper corner dispenser therein, the upper corner dispenser being spaced from the second side panel and the bottom panel, wherein the dispenser pattern comprises:

a first tear line extending across the first side exiting end flap and the first side panel, the first tear line extending perpendicular to the longitudinally extending fold line and extending from the longitudinally extending fold line to an edge of the side exiting end flap;

a second tear line extending across the first side panel to the top panel a third tear line extending from the second tear line and across the top panel, wherein the third tear line is arcuate along at least a majority of its length, a fourth tear line extending perpendicular to the longitudinally extending fold line and extending from the longitudinally extending fold line to an edge of the top exiting end flap, an access feature in the first side panel for providing access to the dispenser flap to initiate separation of the dispenser flap at the dispenser pattern, the access feature being located between respective ends of the first tear line and the second tear line, the respective ends being located in the first side panel.

16. The blank of claim 15, wherein the blank further comprises a second side exiting end flap foldably connected to the second side panel at the longitudinally extending fold line, the dispenser pattern further comprises a fifth tear line extending through the second side exiting end flap.

* * * * *